US007030851B2

(12) United States Patent
Yamazaki

(10) Patent No.: US 7,030,851 B2
(45) Date of Patent: Apr. 18, 2006

(54) ELECTROOPTICAL DEVICE, DRIVING CIRCUIT FOR DRIVING THE ELECTROOPTICAL DEVICE, DRIVING METHOD FOR DRIVING THE ELECTROOPTICAL DEVICE, AND ELECTRONIC EQUIPMENT

(75) Inventor: Katsunori Yamazaki, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 327 days.

(21) Appl. No.: 10/178,484

(22) Filed: Jun. 25, 2002

(65) Prior Publication Data

US 2003/0011696 A1 Jan. 16, 2003

(30) Foreign Application Priority Data

Jul. 9, 2001 (JP) ..... 2001-208517

(51) Int. Cl.
*G09G 3/36* (2006.01)

(52) U.S. Cl. ..... 345/100; 345/99; 345/208

(58) Field of Classification Search ..... 345/80, 345/84, 87, 90, 95, 204, 208–209, 690, 695–699, 345/76, 99–100, 92
See application file for complete search history.

(56) References Cited

U.S. PATENT DOCUMENTS

| | | | | |
|---|---|---|---|---|
| 5,602,561 | A * | 2/1997 | Kawaguchi et al. | 345/99 |
| 5,710,571 | A * | 1/1998 | Kuo | 345/94 |
| 5,949,396 | A * | 9/1999 | Lee | 345/87 |
| 6,040,201 | A * | 3/2000 | Akiba et al. | 438/30 |
| 6,417,830 | B1 * | 7/2002 | Byeon, II | 345/99 |
| 6,440,877 | B1 * | 8/2002 | Yamazaki et al. | 438/780 |
| 6,473,077 | B1 * | 10/2002 | Takenaka et al. | 345/209 |
| 6,476,786 | B1 * | 11/2002 | Miyachi | 345/90 |
| 6,545,656 | B1 * | 4/2003 | Yamazaki | 345/94 |

* cited by examiner

*Primary Examiner*—Amr A. Awad
*Assistant Examiner*—Leonid Shapiro
(74) *Attorney, Agent, or Firm*—Oliff & Berridge, PLC.

(57) ABSTRACT

The invention enhances image quality of a moving image when an electrooptical device presents the image based on an electrooptical change in an electrooptical material. Pixels, which are turned on within one horizontal scanning period, are only provided in four rows, while the four rows are successively shifted downward every horizontal scanning period. In this way, the pixels are turned off within a short period of time, thereby reducing a chance of an image being recognized as an after image.

15 Claims, 12 Drawing Sheets

ELECTROOPTICAL DEVICE, DRIVING CIRCUIT FOR DRIVING THE ELECTROOPTICAL DEVICE, DRIVING METHOD FOR DRIVING THE ELECTROOPTICAL DEVICE, AND ELECTRONIC EQUIPMENT

BACKGROUND OF THE INVENTION

1. Field of Invention

The present invention relates to an electrooptical device appropriate for displaying a moving image, a driving circuit of the electrooptical device, a driving method of the electrooptical device, and electronic equipment.

2. Description of Related Art

Electrooptical devices, presenting an image through electrooptical change, such as a liquid crystal or an organic EL (electroluminescence), are now replacing cathode ray tubes (CRTs) and are now widely used as a display device for a variety of electronic equipment including television sets for the thin, compact, and power-saving designs thereof.

The electrooptical devices, if categorized according to driving method, are mainly divided into an active-matrix type that drives a pixel through switching, and a passive-matrix type that drives a pixel without using a switching element. Since pixels are isolated from each other with switching elements in the active-matrix type, the active-matrix type is believed to present an image higher in image quality than that presented by the passive-matrix type.

In principle, the liquid-crystal device employing liquid crystal as an electrooptical material, from among these matrix type electrooptical devices, writes a voltage responsive to a tonal gradation during a scanning period and retains the voltage until a next scan. The EL device having an organic EL as an electrooptical material must write and retain a voltage responsive to a tonal gradation in a scanning period, and then must continuously flow a current into a pixel in response to the held voltage.

In a given pixel in any device, the same display state is maintained from one scan to a next scan (for one vertical scanning period).

SUMMARY OF THE INVENTION

[Problems to be Solved by the Invention]

An after image is inevitably visible based on the feature that the same display state is maintained for at least one vertical scanning period when an image having motion (a moving image) is displayed on an electrooptical device. The image quality of the moving image is thus low.

The present invention has been developed in view of the above problem, and it is an object of the present invention to provide an electrooptical device appropriate for displaying a moving image, a driving circuit of the electrooptical device, a driving method of the electrooptical device, and electronic equipment.

[Means for Solving the Problems]

To achieve the above object, a driving circuit of the present invention of an electrooptical device for driving a pixel arranged at an intersection of a scanning line and a data line, includes a scanning line driving circuit which selects a scanning line and applies a first selection voltage to the selected scanning line, and selects the scanning line again after selecting at least one of the other scanning lines and applies a second selection voltage to the scanning line, and a data line driving circuit which supplies the data line with a signal that corresponds to the display content of the pixel at the intersection of the scanning line and the data line when the scanning line is supplied with the first selection voltage, and which supplies the data line with a turning-off signal which causes the pixel to be placed in a turned-off state regardless of the display content of the pixel when the scanning line is supplied with the second selection voltage.

In this arrangement, the pixel at the intersection of the scanning line and the data line is supplied with the signal that corresponds to the display content through the data line when the scanning line is supplied with the first selection voltage. The pixel is supplied with the turning-off signal for causing the pixel to be in the turned-off state through the data line when the scanning line is supplied with the second selection voltage. The pixel is in the display state that corresponds to the display content for a period of time from the moment the scanning line is supplied with the first selection voltage until the moment the scanning line is supplied with the second selection voltage. The generation of the after image is thus controlled when a moving image is presented.

Preferably, the data line driving circuit includes a pre-charge circuit which supplies all data lines with the non-lighting signal when the scanning line is supplied with the second selection voltage. In this arrangement, a signal for supplying the pixel with the signal that corresponds to the display content is separated from a signal line for supplying the pixel with the turning-off signal. This arrangement eliminates the need for alternately supplying the common signal line with the signal that corresponds to the display content and the turning-off signal in a time division manner.

The present invention is embodied as a driving method for driving the electrooptical device. A driving method of the present invention of an electrooptical device for driving a pixel arranged at an intersection of a scanning line and a data line includes the steps of selecting a scanning line and supplying a first selection voltage to the selected scanning line, selecting the scanning line again after selecting at least one of the other scanning lines and supplying a second selection voltage to the scanning line, supplying the data line with a signal that corresponds to the display content of the pixel at the intersection of the scanning line and the data line when the scanning line is supplied with the first selection voltage, and supplying the data line with a non-lighting signal which causes the pixel to be placed in a turned-off state regardless of the display content of the pixel when the scanning line is supplied with the second selection voltage.

In this method, the pixel is in the display state that corresponds to the display content for a period of time from the moment the scanning line is supplied with the first selection voltage until the moment the scanning line is supplied with the second selection voltage. The generation of the after image is thus controlled when a moving image is presented.

The present invention is embodied as an electrooptical device itself. An electrooptical device of the present invention having a pixel arranged at an intersection of a scanning line and a data line, includes a scanning line driving circuit which selects a scanning line and applies a first selection voltage to the selected scanning line, and selects the scanning line again after selecting at least one of the other scanning lines and applies a second selection voltage to the scanning line, and a data line driving circuit which supplies the data line with a signal that corresponds to the display content of the pixel at the intersection of the scanning line and the data line when the scanning line is supplied with the first selection voltage, and which supplies the data line with a turning-off signal which causes the pixel to be placed in a turned-off state regardless of the display content of the pixel when the scanning line is supplied with the second selection voltage.

As in the above-referenced driving circuit, the pixel is in the display state that corresponds to the display content for a period of time from the moment the scanning line is supplied with the first selection voltage until the moment the scanning line is supplied with the second selection voltage. The generation of the after image is thus controlled when a moving image is presented.

In the electrooptical device, the pixel includes a pixel electrode, a counter electrode opposed to the pixel electrode, and a liquid crystal sandwiched between the pixel electrode and the counter electrode and having optical characteristics which vary depending on a voltage applied between the two electrodes. In a structure in which a liquid crystal layer is sandwiched between a pixel electrode and an opposing electrode, an after image is likely to occur because the voltage applied to the pixel electrode is held due to the capacitance between the electrodes, and the pixel holds a display state. The electrooptical device of this invention sets the pixel into a turned-off state when the second selection voltage is supplied. The after image thus becomes less visible.

In the electrooptical device, a signal that is applied to the pixel electrode when the scanning line is supplied with the first selection voltage is preferably inverted in polarity with respect to a voltage applied to the counter electrode as a reference every at least one vertical scanning period, and the signal that is applied to the pixel electrode when the scanning line is supplied with the first selection voltage is preferably inverse in polarity to the non-lighting signal that is applied to the pixel electrode when the scanning line is supplied with the second selection voltage. Since no DC component is applied to the liquid crystal in this arrangement, degradation of the liquid crystal is prevented. The polarity of the turning-off signal applied to the pixel electrode when the second selection voltage is applied is identical to that of the signal that is applied to the pixel electrode when the first selection signal is applied next. The period of time during which the signal that corresponds to the display content is applied to the pixel is short. This arrangement generally applies to the liquid-crystal device.

Preferably, the electrooptical device includes a pixel electrode, a non-linear resistive element connected to the pixel electrode, and a liquid-crystal layer sandwiched between the pixel electrode and one of the data line and the scanning line and having optical characteristics that vary depending on a voltage applied therebetween. In a structure in which a liquid crystal layer is sandwiched between a pixel electrode and one of a data line and a scanning line, an after image is likely to occur because the voltage applied to the pixel electrode is held due to the capacitance between the electrodes, and the pixel holds a display state. The electrooptical device of this invention sets the pixel into a turned-off state when the second selection voltage is supplied. The after image thus becomes less visible.

In this arrangement, a signal that is applied to the pixel electrode when the scanning line is supplied with the first selection voltage is preferably inverted in polarity with respect to the voltage applied to the data line or the scanning line as a reference every at least one vertical scanning period, and the signal that is applied to the pixel electrode when the scanning line is supplied with the first selection voltage is preferably inverse in polarity to the turning-off signal that is applied to the pixel electrode when the scanning line is supplied with the second selection voltage. Since no DC component is applied to the liquid crystal in this arrangement, as well, degradation of the liquid crystal is prevented. The polarity of the turning-off signal applied to the pixel electrode when the second selection voltage is applied is identical to that of the signal that is applied to the pixel electrode when the first selection signal is applied next. The selection voltage required to apply the signal that corresponds to the display content to the pixel electrode is set to be low. This arrangement is typically applied to the liquid-crystal device.

In the above-referenced electrooptical device, the pixel preferably includes a pixel electrode, an opposing electrode opposed to the pixel electrode, and a light emitting layer sandwiched between the pixel electrode and the counter electrode, the amount of emitting light varies depending on a current flowing therebetween. This arrangement is typically applicable to an organic EL.

The electronic equipment of the present invention includes the above-referenced electrooptical device as a display, which makes it possible to display a high-definition moving image while preventing generation of after images.

Such electronic equipment may be a television receiver. If the electronic equipment includes a liquid-crystal electrooptical device, the electronic equipment may be a projector or a personal computer. The electronic equipment can be a mobile telephone if the liquid-crystal electrooptical device or the organic EL is used.

DETAILED DESCRIPTION OF PREFERRED EMBODIMENTS

The embodiments of the present invention will be discussed with reference to the drawings.

<First Embodiment>

Figure 1:
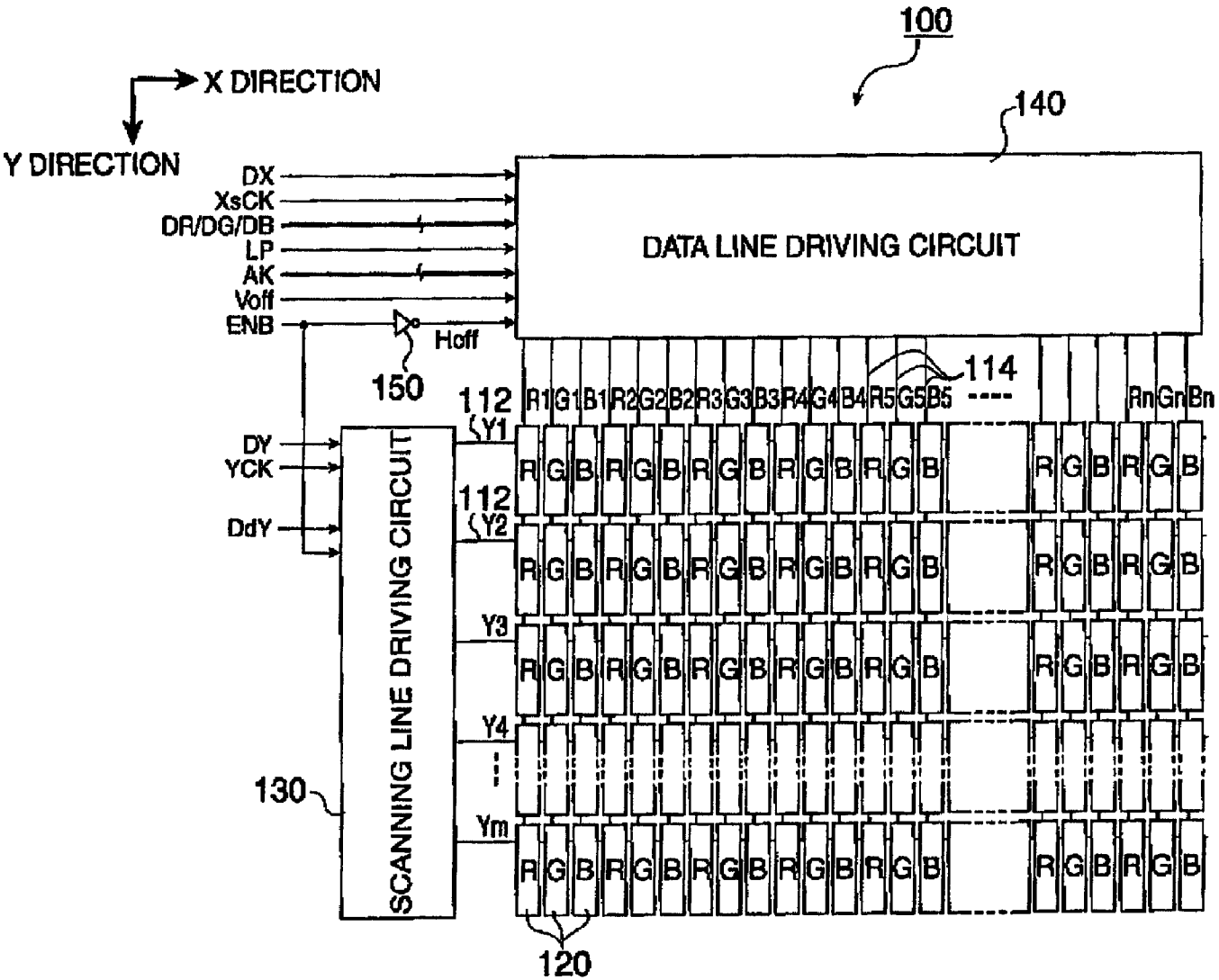
FIG. 1 is a block diagram illustrating the electrooptical device of a first embodiment of the present invention.

An electrooptical device of a first embodiment of the present invention will be discussed. FIG. 1 is a block diagram illustrating the configuration of the electrooptical device.

As shown in the figure, the electrooptical device 100 includes m scanning lines 112 extending in the direction of rows (X direction) and (3×n) data lines 114 extending in the direction of columns (Y direction) (here, m and n are plural numbers).

Each scanning line 112 is supplied with a scanning signal from a scanning line driving circuit 130, while each data line 114 is supplied with a data signal from a data line driving circuit 140.

Substantially square dots are formed of three pixels 120 of R (red), G (green) and B (blue), the dots being positioned at each of the respective intersections of the scanning lines 112 and the data lines 114 and being adjacent to each other in the row direction. In other words, the display resolution of the electrooptical device 100 is m vertical dots by n horizontal dots. The order of arrangement of the pixels may be arbitrarily set and is not limited to the order of R, G and B. The arrangement of the pixels may be set to be in any configuration, and is not limited to the stripe configuration shown in FIG. 1.

The electrooptical device 100 is capable of displaying 16 (=24) gray levels for a given single color pixel according to the 4-bit gray scale data. The electrooptical device 100 therefore presents a color presentation of 4069 (24×3) colors per dot.

<Pixels>

Figure 2:
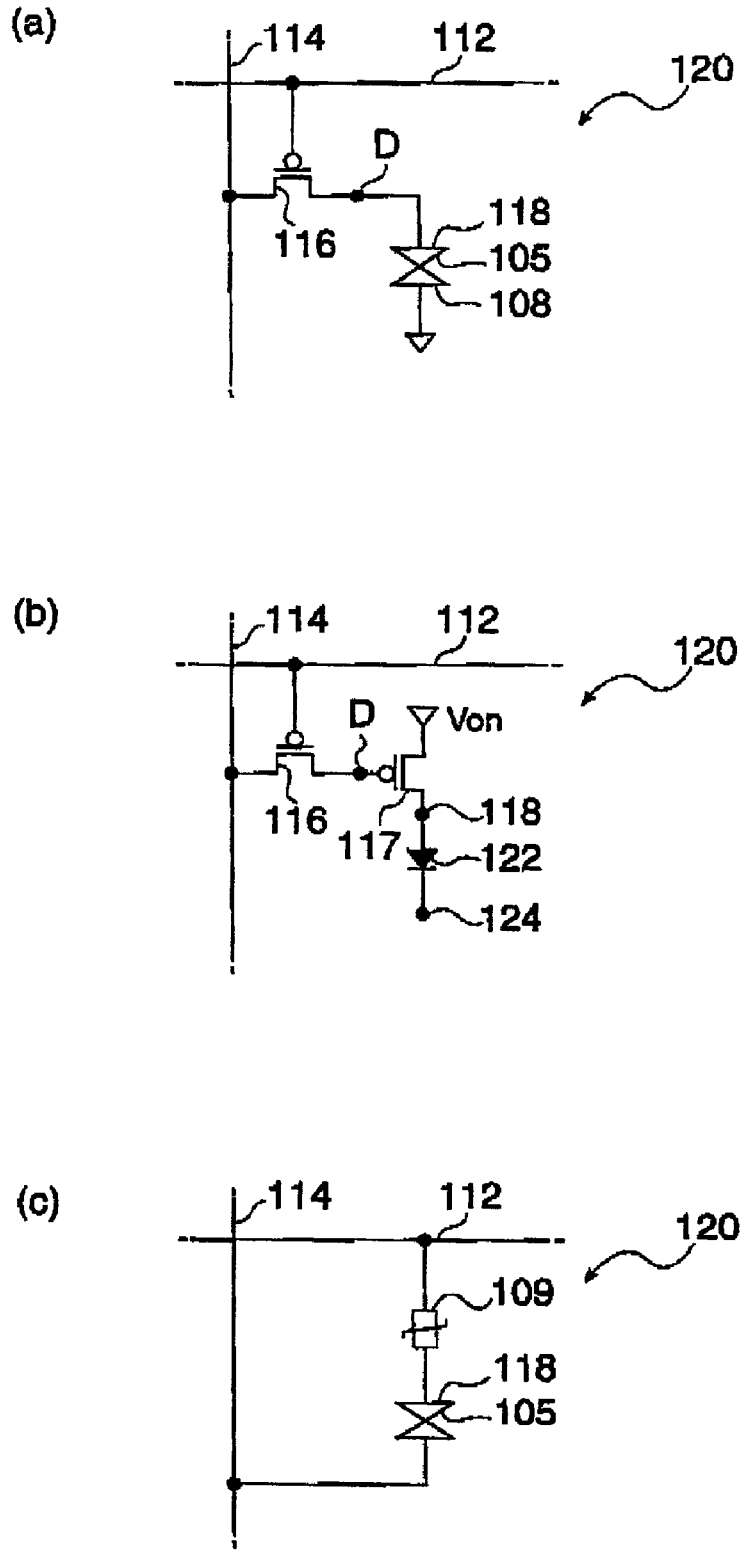
FIGS. 2(*a*), 2(*b*), and 2(*c*) illustrate the construction of pixels in the electrooptical device.

The configuration of the pixel 120 will now be discussed. FIG. 2(*a*) is an equivalent circuit diagram illustrating the pixel 120 when liquid crystals are used as the electrooptical material. As shown in the figure, the pixel 120 includes a thin-film transistor (hereinafter referred to as "TFT") 116 formed in an area where a scanning line 112 and a data line 114 intersect each other (with both lines electrically insulated from each other), with the gate thereof connected to the scanning line 112, the source thereof connected to the data line 114, and the drain D thereof connected to a pixel electrode 118. Assuming that the TFT 116 is a P-channel type in this embodiment, the TFT 116 is turned on between the source and the drain thereof when the scanning signal fed to the scanning line 112 is driven low.

The pixel electrode 118 is opposed to an opposing electrode 108 to which a constant voltage is applied. The two electrodes and a liquid crystal 105 sandwiched therebetween form a liquid-crystal capacitor (a liquid-crystal layer). There are cases in which the drain D (the pixel electrode 118) of the TFT 116 is formed with a storage capacitor to reduce the leakage of charge stored in the liquid-crystal capacitor. Since this is not closely related to the present invention, the discussion of the storage capacitor is omitted here in the discussion of the first embodiment.

In this arrangement, when the scanning signal applied to the scanning line 112 is driven low, the TFT 116 with the gate thereof connected to the scanning line 112 is turned on. Thus, the potential of the pixel electrode 118 depends on the data signal applied to the data line 114 (strictly speaking, the on resistance of the TFT 116 is not zero, and the wiring resistance of each line is not zero, so that in practice the voltage drop across these resistance components needs to be accounted for, but here the voltage drop is ignored). A charge depending on the voltage of the data signal is stored in the liquid-crystal capacitor. Subsequent to the storage, the charge is maintained in the pixel electrode 118 even when the TFT 116 is turned off in response to the transition of the scanning signal to a high level.

Since the orientation of liquid-crystal molecules changes depending on the amount of charge stored in the liquid crystal, the amount of light transmitted through the liquid-crystal capacitor, emerged from a polarizer (not shown), and then recognized by a user also changes depending on the amount of stored charge.

The display state of the pixel 120 thus corresponds to the voltage of the data signal when the scanning signal is driven low.

Besides the liquid crystal 105, an organic EL may be used as an electrooptical material in this embodiment. A device employing the organic EL as an electrooptical material will be discussed later. This embodiment also employs the TFTs. Alternatively, a non-linear resistive element may be used. The arrangement formed of the non-linear resistive element will also be discussed later.

<Scanning Line Driving Circuit>

Figure 3:
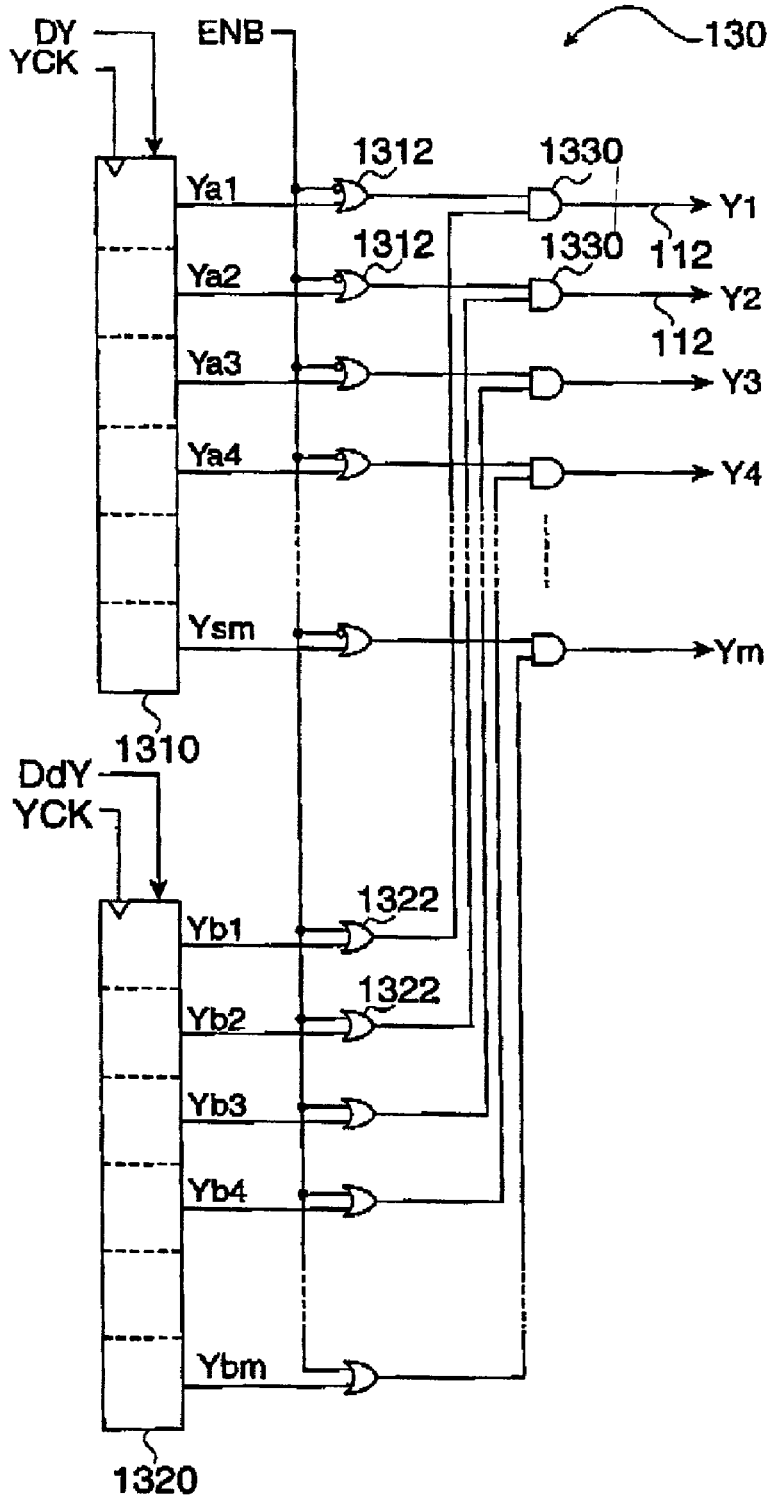
FIG. 3 is a block diagram illustrating the construction of a scanning line driving circuit in the electrooptical device.

The scanning line driving circuit 130 will now be discussed in detail. FIG. 3 is a block diagram illustrating the configuration of the scanning line driving circuit 130.

As shown in the figure, a shift register 1310 latches a pulse signal DY (see FIG. 4), defining the start of each vertical scanning period, at a rising edge of a clock signal YCK. The shift register 1310 also successively delays the latched signal every one period of the clock signal YCK, thereby outputting transfer signals Ya1, Ya2, Ya3, . . . , Yam.

The shift register 1310 has an OR gate 1312 provided at its output in a one-to-one correspondence with a scanning line 112. Specifically, one end of the OR gate 1312 is supplied with a corresponding one of the respective transfer signals Ya1, Ya2, Ya3, . . . , Yam while the other end of the OR gate 1312 is supplied in common with the control signal ENB.

The control signal ENB is a signal for splitting one horizontal period (1H). Specifically, in one horizontal scanning period (1H), the control signal ENB is driven high during a write period of a signal representing the display content of the pixel 120, and is driven low during a write period of a signal for forcefully causing the pixel to be in a turned-off state (see FIG. 4).

The OR gate 1312 outputs an OR signal that is obtained by combining the corresponding transfer signal and the inverted version of the control signal ENB.

A shift register 1320 in this embodiment latches a pulse signal DdY (see FIG. 4), which is delayed by three periods (three horizontal scanning periods) of the clock signal YCK from the pulse signal DY, at the rising edge of the clock signal YCK. The shift register 1320 successively delays the latched signal every period of the clock signal YCK, thereby outputting transfer signals Yb1, Yb2, Yb3, . . . , Ybm.

The shift register 1320 has an OR gate 1322 provided at its output in a one-to-one correspondence with a scanning line 112. Specifically, one end of the OR gate 1322 is supplied with a corresponding one of the respective transfer signals Yb1, Yb2, Yb3, . . . , Ybm while the other end of the OR gate 1322 is supplied in common with the control signal ENB.

The OR gate 1322 outputs an OR gated signal that is obtained by OR gating the corresponding transfer signal and the inverted version of the control signal ENB.

An AND gate 1330 is arranged in a one-to-one correspondence with a scanning line 112, and it supplies a scanning signal to the corresponding scanning line 112, the scanning signal consisting of an AND signal that combines the output signal of the corresponding OR gate 1312 and the output of the corresponding OR gate 1322.

Generally, the AND gate 1330 corresponding to the i-th row scanning line 112 (i is an integer satisfying the condition of 1 £ i £ m) combines the OR signal of the i-th row OR gate 1312 and the OR signal of the i-th row OR gate 1322, and feeds the resultant AND signal to the i-th row scanning line 112 as a scanning signal Yi.

Figure 4:
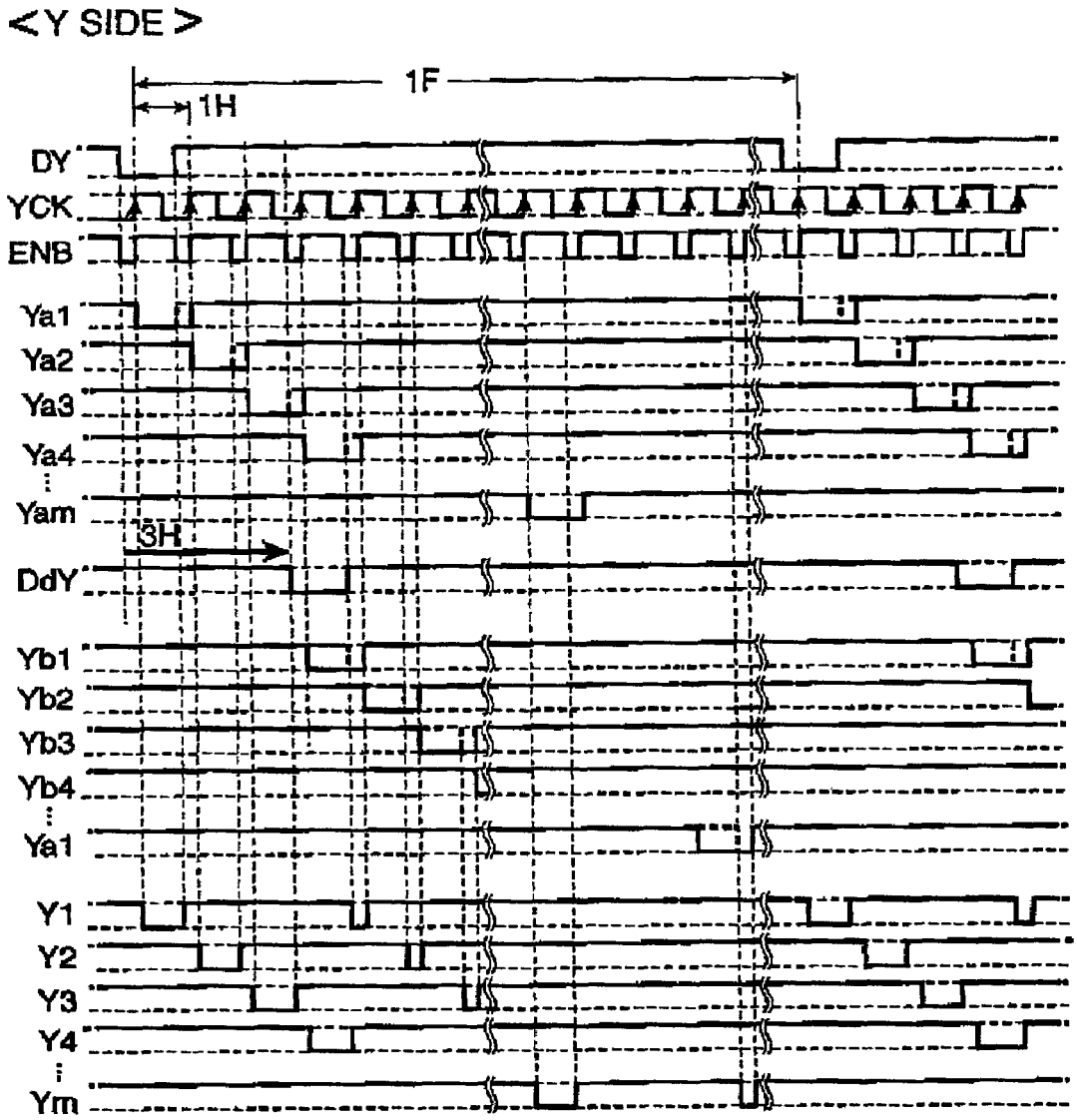
FIG. 4 is a timing diagram illustrating the operation of the scanning line driving circuit.

The signal waveform of the scanning signals Y1, Y2, Y3, . . . , Ym output from the scanning line driving circuit 130 is discussed with reference to FIG. 4.

The pulse signal DY supplied first in a vertical scanning period (1F) is latched by the shift register 1310 at the rising edge of each clock signal YCK, and the latched signal is successively shifted and output as transfer signals Ya1, Ya2, Ya3, . . . , Yam as represented by solid lines.

As represented by heavy broken lines, the pulse form of each of the transfer signals Ya1, Ya2, Ya3, . . . , Yam is limited by the OR gate 1312 to the high level period of the control signal ENB.

The pulse signal DdY, delayed by three periods of the clock signal YCK from the pulse signal DY, is latched at the rising edge of each clock signal YCK by the shift register 1320. The latched signal is then successively shifted and is output as transfer signals Yb1, Yb2, Yb3, . . . , Ybm as represented by solid lines. For this reason, the transfer signals Yb1, Yb2, Yb3, . . . , Ybm are respectively delayed from the transfer signals Ya1, Ya2, Ya2, . . . , Yam by the three periods of the clock signal YCK.

The pulse form of each of the transfer signals Yb1, Yb2, Yb3, . . . , Ybm is limited by the OR gate 1322 to the low level period of the control signal ENB as represented by heavy broken lines.

The AND gates 1330 respectively AND gate the transfer signals Ya1, Ya2, Ya3, . . . , Yam and the transfer signals Yb1, Yb2, Yb3 , . . . , Ybm with respect to the corresponding row, and outputs the AND gated signal as the scanning signal.

In other words, when the scanning signal Yi supplied to the i-th row scanning line 112 is driven low (in a first selection voltage) for a period during which the control signal ENB is HIGH, the scanning signal Yi is also driven low (in a second selection signal) three horizontal scanning periods later for a period during which the control signal ENB is LOW.

During any one given horizontal scanning period (1H), if the scanning signal Yi is driven low for a period in which the control signal ENB is HIGH, and if the control signal ENB is transitioned to a low level, then the scanning line Y(i−3) three rows above the scanning line Yi is transitioned to a low level again.

Specifically, during any one given horizontal scanning period, if the scanning signal Yi is driven low for a period in which the control signal ENB is HIGH, then immediately after that scanning signal Y(i−3) is driven low when the control signal ENB is transitioned to a low level.

<Data Line Driving Circuit>

The data line driving circuit 140 will be discussed in detail. The data line driving circuit 140 supplies the data line 114 with the data signal that corresponds to the gray level (gray scale) of the pixel 120 at a selected scanning line.

To give a general description of the direction of columns, assuming that the letter j is used (j is an integer satisfying the condition of 1 £ j £ n), data signals respectively fed to the data lines 114 at a (3j−2)-th column, a (3j−1)-th column, and (3j)-th column, can be respectively designated Rj, Gj, and Bj. In other words, the pixels 120 of R, G, and B that form the dots at the j-th column are supplied with the data signals Rj, Gj, and Bj.

Figure 5:
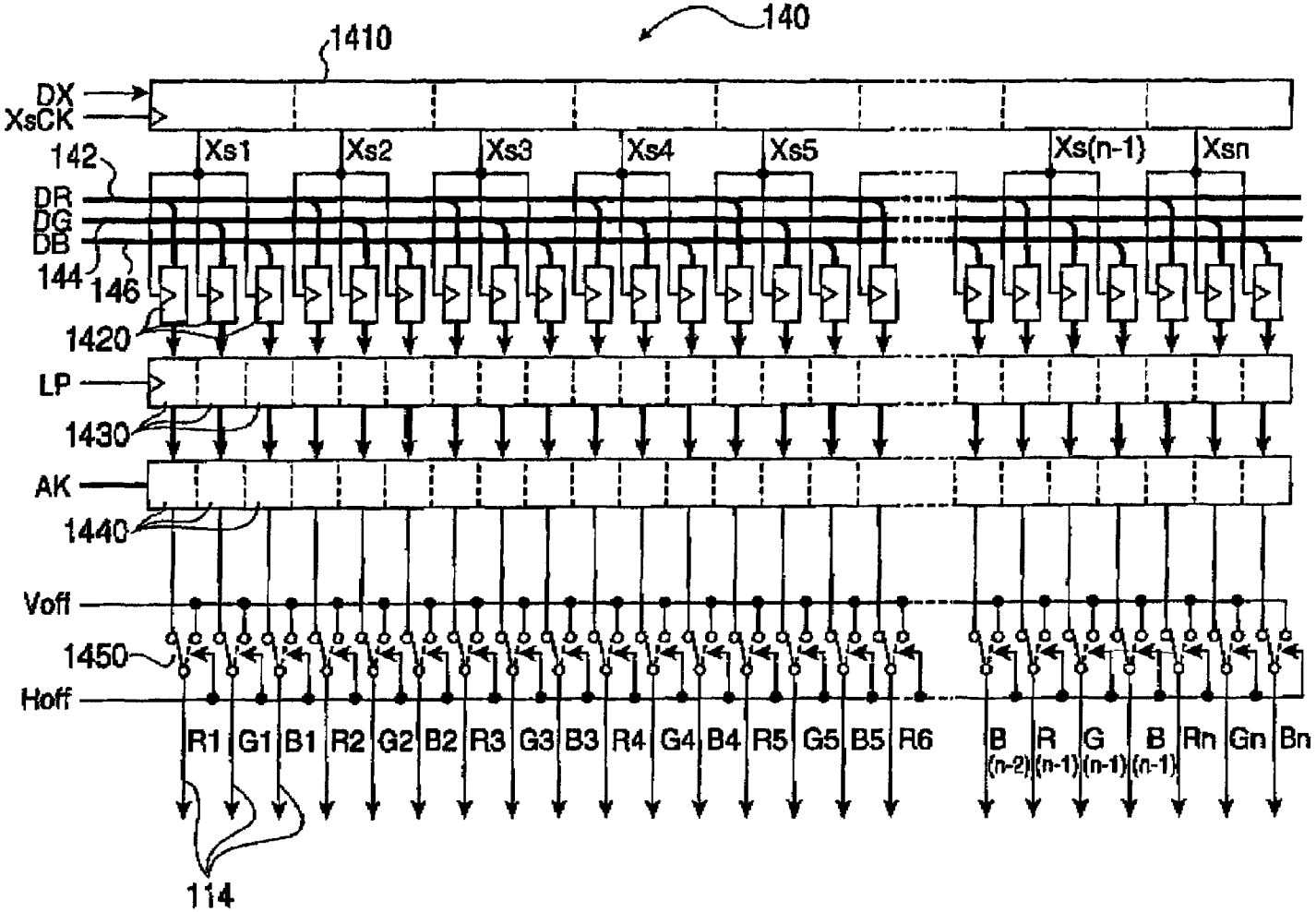
FIG. 5 is a block diagram illustrating the construction of a data line driving circuit in the electrooptical device.

The configuration of the data line driving circuit 140 is detailed with reference to FIG. 5. As shown in the figure, a shift register 1410 successively shifts a pulse signal DX, supplied first in the horizontal scanning period, at the rising edge of each clock signal XsCK, thereby outputting sampling control signals Xs1, Xs2, Xs3, . . . , Xsn.

Figure 6:
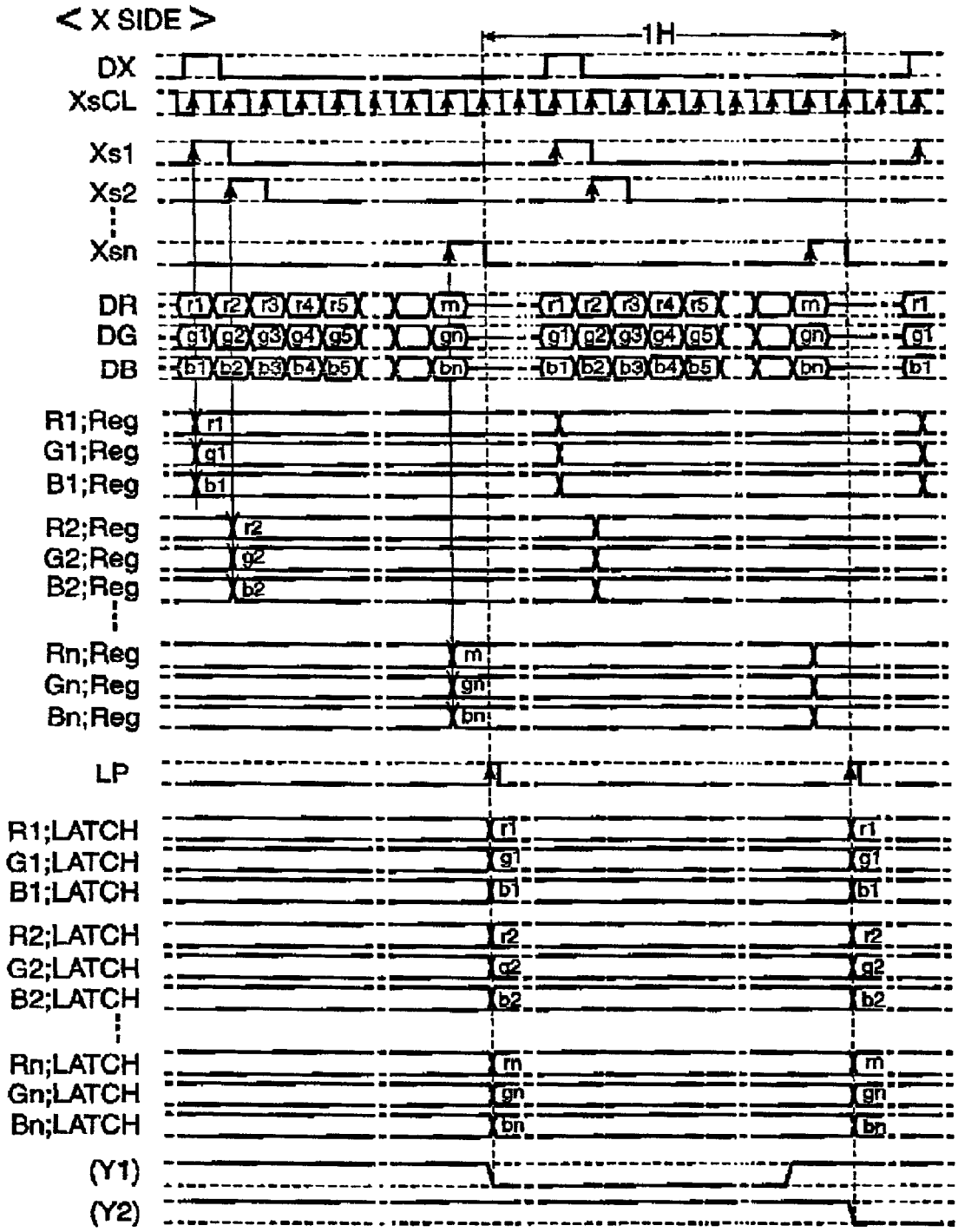
FIG. 6 is a timing diagram illustrating the operation of the data line driving circuit.

Gray scale data DR, DG, and DB corresponding to R, G, and B are fed to the pixels through signal lines 142, 144, and 146 from a hierarchically higher device (not shown) as shown in FIG. 6. The gray scale data DR, DG, and DB in this embodiment are 4 bit data representing gray levels of R, G, and B pixels 120.

A register (Reg) 1420 is arranged in one-to-one correspondence with one data line 114. The gray scale data fed to one of the signal lines 142, 144, and 146 is sampled at the rising edge of the sampling control signal, and held. Generally, the registers 1420, corresponding to the data lines 114 supplied with the data signals Rj, Gj, and Bj, are respectively connected to the signal lines 142, 144, and 146, while being supplied in common with the sampling control signal Xsj.

At the rising edge of the sampling control signal Xsj, the gray scale data DB, DG, and DB respectively fed to the signal lines 142, 144, and 146 are concurrently held at the respective registers 1420.

A latch circuit 1430 is arranged in a one-to-one correspondence with one register 1420. The latch circuit 1430 latches the gray scale data held by the corresponding register 1420 at the rising edge of a latch pulse LP supplied at the beginning of one horizontal scanning period, and outputs the latched gray scale data.

A converter circuit 1440 is arranged in one-to-one correspondence with one data line 114, namely, in one-to-one correspondence with the latch circuit 1430. The converter circuit 1440 converts the latched gray scale data into an analog signal having a polarity represented by a signal AK, and feeds the analog signal to the data line 114.

The polarity represented by the signal AK in this embodiment is determined with respect to a voltage applied to the opposing electrode 108 (or a voltage near the voltage applied to the opposing electrode 108) used as the reference. A positive polarity refers to a positive side above the reference voltage, and a negative polarity refers to a negative side below the reference voltage.

A switch 1450 is arranged in one-to-one correspondence with the data line 114 (namely, in one-to-one correspondence with the converter circuit 1440). The switch 1450 selects either of the signal converted by the corresponding converter circuit 1440 or the turning-off signal Voff that turns off the pixel (into the off state) according to the logic level of the control signal Hoff, and outputs the selected signal to the data line 114 as the data signal. More in detail, the switch 1450 selects the signal converted by the corresponding converter circuit 1440 at its position represented by a solid line when the control signal Hoff is at a high level, and selects the non-lighting voltage Voff at its position represented by a broken line when the control signal Hoff is at a low level. The control signal Hoff is obtained by logically inverting the control signal ENB through an inverter 150 (see FIG. 1).

The operation of the data line driving circuit 140 is discussed below with reference to FIG. 6.

As shown in the figure, prior to the duration of time within which the scanning signal Yi at the i-th row is driven low, the gray scale data for dots in the i-th row and the first column, in the i-th row and the second column, . . . , in the i-th row and the n-th column is successively fed in synchronization with the clock signal XsCL.

When the shift register 1410 drives the sampling control signal Xs1 high for the duration of time within which the gray scale data DR, DG, and DB are fed in the i-th row and the first column, the gray scale data DR, DG, and DB are held by registers 1420 corresponding to the data lines 114 supplied with the data signals R1, G1, and B1.

When the shift register 1410 drives the sampling control signal Xs2 high for the duration of time within which the gray scale data DR, DG, and DB are fed in the i-th row and the second column, the gray scale data DR, DG, and DB are held by registers 1420 corresponding to the data lines 114 supplied with the data signals R2, G2, and B2.

A similar operation is repeated until the gray scale data DR, DG, and DB at the dots in the i-th row and the n-th column are held in the registers 1420 corresponding to the data lines 114 at the 3(n−2)-th column, the 3(n−1)-th column, and the 3n-th column.

When the gray scale data DR, DG, and DB corresponding to the final dots at the i-th row and the n-th column are held in the respective registers 1420, the latch pulse LP is output at the timing the scanning signal Yi is driven low. The gray scale data held at the registers 1420 corresponding to the columns is concurrently latched by the latch circuits 1430. The latched gray scale data is converted into analog signals through the converter circuits 1440, and is concurrently fed to the data lines 114 as the data signal.

When the control signal ENB is transitioned to a low level in this state, the scanning signal Yi is driven high. Since the control signal Hoff is transitioned to a high level, the data signal applied to the data line 114 is switched from the analog signal from the converter circuit 1440 to the turning-off signal Voff.

A general discussion of the operation of supplying the pixel 120 at the i-th row scanning signal 112 with the data signal has been made. The supply operation of the data signal to each row is performed in the order from the first row, the second row, the third row, . . . , the m-th row.

<Write Operation to the Pixel>

Figure 7:
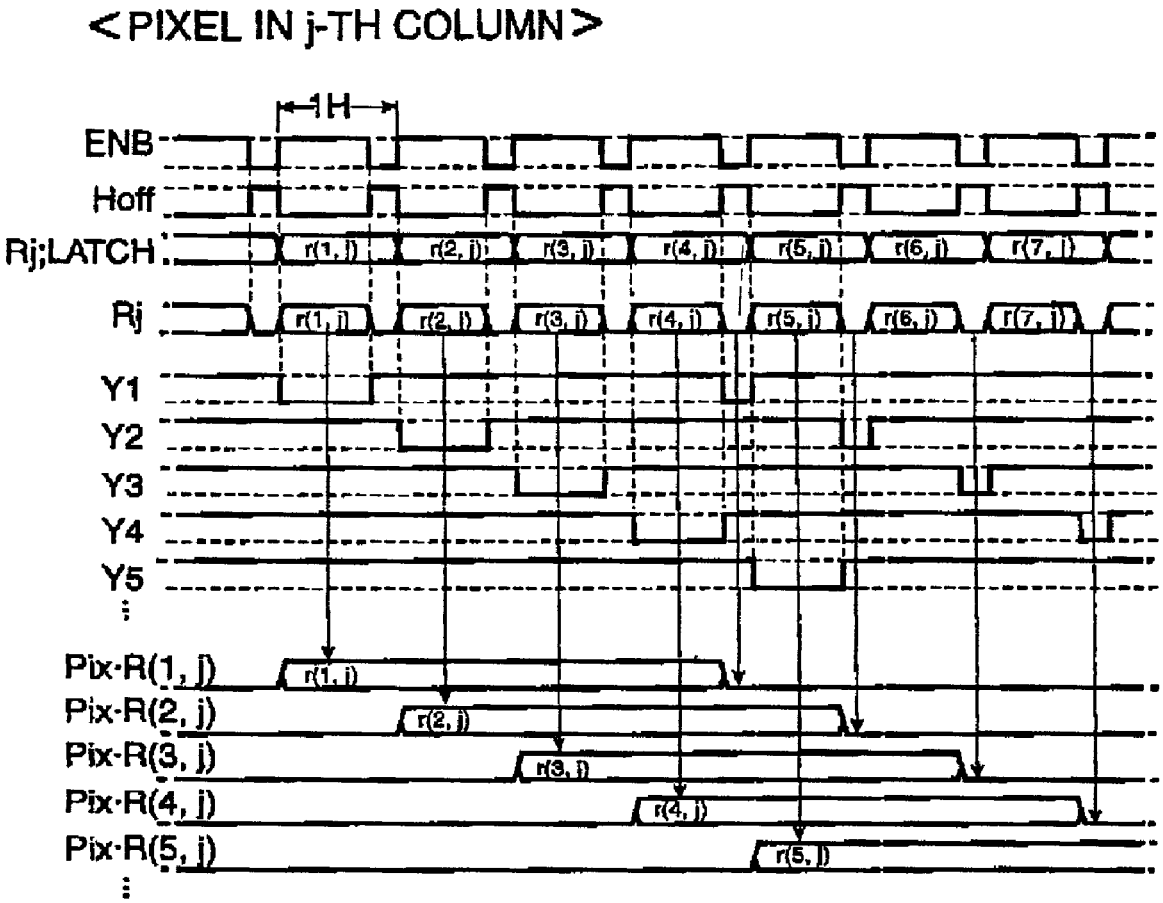
FIG. 7 is a timing diagram illustrating the display operation of the electrooptical device.

The write operation to the pixel 120 responsive to the aforementioned scanning signal and data signal is discussed concerning the R (red) pixel 120 of the j-th column dot. FIG. 7 is a timing diagram illustrating the write operation.

When the scanning signal Y1 becomes low for the high level period of the control signal ENB within one horizontal scanning period (1H) in which the first row scanning line 112 is selected, each of the pixel electrodes 118 of the pixels 120 in the first row has a voltage that corresponds to the data signal in response to the TFT 116 being turned on. Thereby, each of the pixels 120 in the first row is turned on at the gray level (gray scale) that corresponds to the voltage of the data signal applied to the pixel electrode 118.

For example, since a data signal Rj, into which the gray scale data DR latched by the latch circuit 1430 has been converted after having gone through analog-conversion done by the converter circuit 1440, is applied to the pixel electrode 118 of the R pixel 120 of the dot at the first row and the j-th column, the pixel is turned on at a gray level that corresponds to the voltage of the data signal Rj.

Here, the symbol r(1,j) represents the gray scale data DR corresponding to the R (red) pixel 120 in the first row and the j-th column.

When the scanning signal Y1 becomes high for the low level period of the control signal ENB within one horizontal scanning period (1H) in which the first row scanning line 112 is selected, the TFT 116 is turned off. However, the liquid crystal capacitor of the pixels 120 in the first row hold charge stored for a duration of time within which the TFT 116 is turned on, whereby the turned-on state is thus maintained.

When the scanning signal Y2 becomes low for the high level period of the control signal ENB within one horizontal scanning period (1H) in which the second row scanning line 112 is selected, each of the pixel electrodes 118 of the pixels 120 in the second row has a voltage that corresponds to the data signal in response to the TFT 116 being turned on. Thereby, each of the pixels 120 in the second row is turned on at a gray level (gray scale) that corresponds to the voltage of the data signal applied to the pixel electrode 118.

For example, since a data signal Rj, into which the gray scale data r(2,j) latched by the latch circuit 1430 has been converted after having gone through analog-conversion done by the converter circuit 1440, is applied to the pixel 118 of the R pixel 120 of the dot at the second and the j-th column, the pixel is turned on at a gray level that corresponds to the voltage of the data signal Rj.

When the scanning signal Y2 becomes high for the low level period of the control signal ENB within one horizontal scanning period (1H) in which the second row scanning line 112 is selected, the TFT 116 is turned off. However, the liquid crystal capacitor of the pixel 120 in the second row hold charge stored for a duration of time within which the TFT 116 is turned on, Thereby, the turned-on state is thus maintained.

The storage operation of charge is performed in a similar manner for the third row, the fourth row, and so forth, so that the pixels in each row are turned on in response to the data signal. When the control signal ENB is driven low within the one horizontal period (1H) in which the fourth-row scanning line 112 is selected, the scanning line Y1 is driven low again in this embodiment.

On the other hand, when the control signal ENB is driven low, the control signal Hoff becomes high which toggles the switch 1450, causing all data signals to turn into turned-off signals Voff. Because of this, all charges stored in the liquid crystal capacitor in the pixels 120 in the first row are cleared. As a result, the pixels 120 in the first row shift from a turned-on state to a turned-off state.

When the control signal ENB is driven low within the one horizontal period (1H) in which the fifth-row scanning line 112 is selected, the scanning line Y2 becomes low again. For the same reason, the pixels 120 in the second row shift from the turned-on state to the turned-off state.

Accordingly, generally speaking about an i-th row scanning line 112 in this embodiment, when the pixels 120 in the i-th row scanning line 112 are turned on in response to the data signal during a period in which the control signal ENB is HIGH (the low-level period of the control signal Hoff) within the one horizontal scanning period in which the i-th row scanning line 112 is selected. The turned-on state of the i-th row pixels 120 is maintained until the control signal ENB becomes high within the horizontal scanning period in which the (i+3)-th row scanning line 112 is selected, which is three rows lower, and the pixels 120 are forced to be in the turned-off state when the control signal ENB is driven low.

Therefore, in this embodiment, the pixels 120 are turned on during only a fraction (less than four horizontal scanning periods) of one vertical scanning period (1F), but the gray level(brightness) actually recognized by the user is determined depending on the ratio of the duration of the turned-on state to unit time (one vertical scanning period) and the gray level of the turned-on state.

If the scanning signal Yi is at a low level with the control signal ENB being at a high level during one horizontal scanning period (1H) in which the i-th row scanning line 112 is selected and if the control signal ENB is then transitioned to a low level, then the scanning signal Y(i−3), three lines above, is driven low.

Specifically, when the scanning line Li is at a low level with the control signal ENB being at a high level within the one horizontal scanning period in which the i-th row scanning line 112 is selected, the pixels 120 which are in the turned-on state are those in four rows, namely, the (i−3) row through the i-th row.

Figure 8:
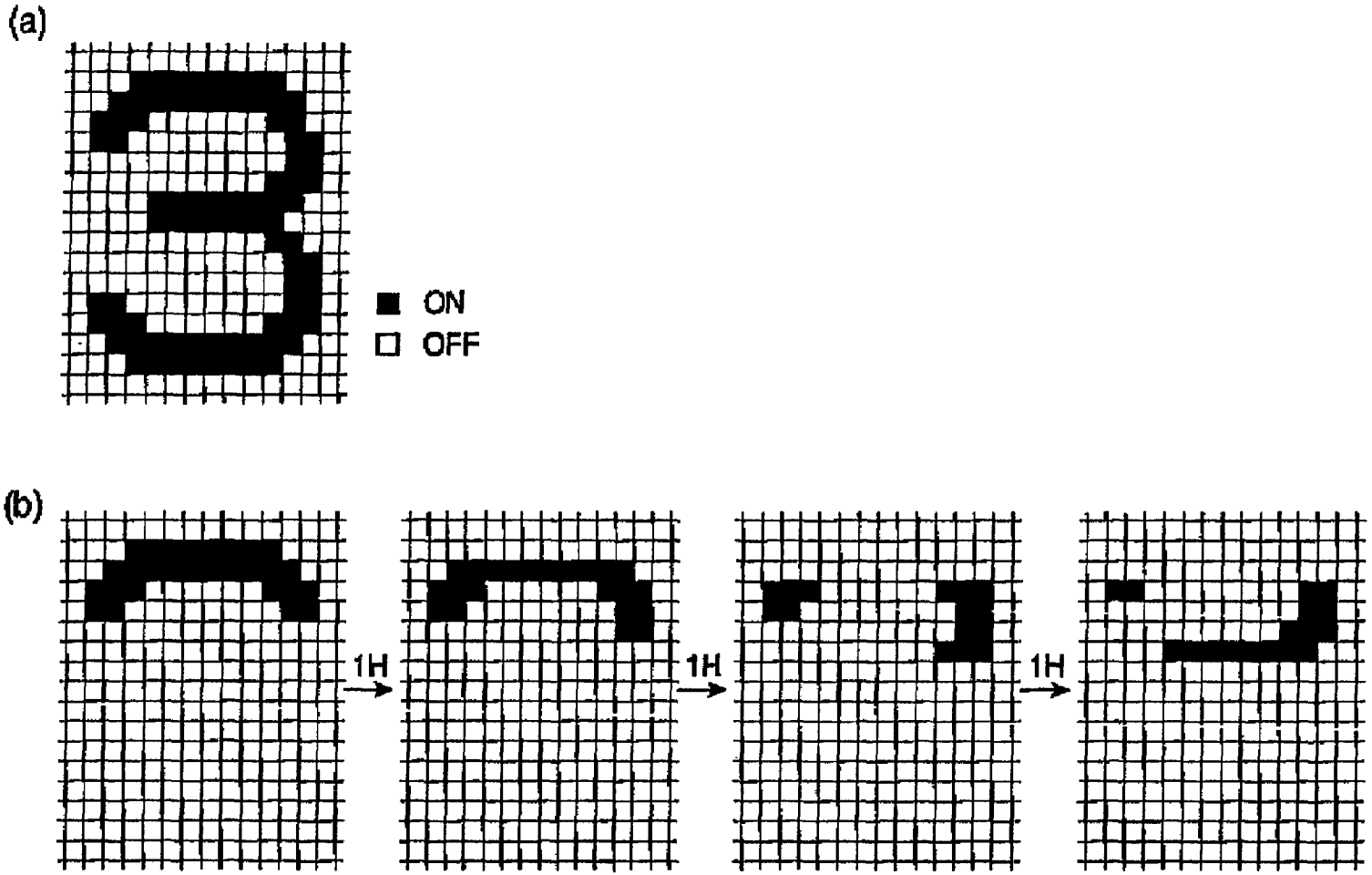
FIG. 8(*a*) illustrates the display operation of a conventional electrooptical device, and FIG. 8(*b*) illustrates the display operation of the electrooptical device of one embodiment of the present invention.

The pixels in the four rows in the turned-on state are successively shifted downward every horizontal scanning period (1H). For example, a display shown in FIG. 8(*a*) is now presented. Consecutive four rows of pixels are in the turned-on state as shown in FIG. 8(*b*), and then the pixels in the turned-on state shift downward every horizontal scanning period.

Thus, the pixels recognized as being in the turned-on state are always four rows of pixels or less. However, since the turned-on state is successively shifted downward, these pixels are recognized as a single image to the eyes of the user.

The fact that the pixels recognized as being in the turned-on state are four rows of pixels or less means that the continuous duration of time of the turned-on state is less than the four horizontal scanning period, and that the display state of the same gray level (excluding the turned-off state) is completed within a short period of time.

To present a moving image, the display state of the same gray level lasts for one vertical scanning period and this is visibly recognized as an after image in the conventional art. In this embodiment, however, the display state having the same gray level is completed within a short period of time, thereby making an after image hardly visible.

In the known art, a single image formed across one vertical scanning period is continuously changed to present a moving picture. In contrast, this embodiment takes an approach in which the consecutive four rows are shifted in a vertical scan to present a moving picture. The chance of recognizing the after image resulting from the long continuous display state of the same gray level is reduced.

<Application of the First Embodiment>

In the above-referenced embodiment, the discussed liquid-crystal device employs a liquid crystal as an electrooptical material and presents an image in response to an electrooptical change in the material. Besides this type of the electrooptical device, the present invention is applicable to a variety of display devices.

The present invention is applicable to an organic EL device, and the equivalent circuit for the pixel 120 in this case is illustrated in FIG. 2(*b*). Referring to FIG. 2(*b*), the drain D of the TFT 116 is connected to the gate of a TFT 117. The source of the TFT 117 is connected to a power supply line to which a signal Von for turning on the pixel 120 is fed, and the drain of the TFT 117 is connected to the pixel electrode (an anode) 118. An EL device 122 includes a pixel electrode as an anode, a cathode 124, and an electroluminescence (EL) layer for each of R, G, and B sandwiched between the pixel electrode and the cathode 124.

In this arrangement, the TFT 117 functions as a voltage-controlled, constant current circuit. Specifically, the TFT 117 outputs a current that corresponds to the voltage between the gate and the source. When the TFT 116 is turned on and then off, the voltage of the drain D is kept at the same level as the on voltage by means of its parasitic capacitance. The TFT 117 feeds a current that corresponds to the voltage to the EL device 122, thereby causing the EL device 122 to continuously emit light of a predetermined brightness.

FIG. 2(*b*) illustrates the principle of the EL device 122. The characteristics of the TFT 117 as the voltage controlled constant current circuit can vary, and in practice, a circuit for compensating for the variations is added, or the signal on the data line is current rather than voltage. These components are not closely related to the present invention, and no further discussion thereof is provided.

An LED (Light Emitting Diode) may be substituted for the EL device 122 in FIG. 2(*b*).

The present invention is applicable to a two-terminal active-matrix liquid-crystal device having a non-linear resistive element. The equivalent circuit of the pixel 120 is illustrated in FIG. 2(*c*). A scanning line 112 is formed on one substrate and a data line 114 is formed on the other substrate with a liquid-crystal layer sandwiched between the two substrates. The pixel 120 includes a pixel electrode 118 formed on the same substrate as the scanning line 112, at an intersection of the scanning line 112 and the data line 114, and a non-linear resistive element 109 between the pixel electrode 118 and the scanning line 112.

The non-linear resistive element 109 has the feature that the resistance thereof rapidly decreases as the absolute value of a voltage applied thereto increases above the threshold voltage thereof. In other words, the non-linear resistive element 109 is a switching element which is turned on above the threshold voltage. Many types of the non-linear resistive element 109 are available. One type of the non-linear resistive element 109 is an MIM (Metal-Insulator-Metal) element in which the surface of a metal layer is coated with an insulator, and a metal is then deposited on the insulator. Here in this arrangement, the pixel electrode 118 and the non-linear resistive element 109 are arranged on the side of the scanning line 112. Alternatively, the pixel electrode 118 and the non-linear resistive element 109 may be deposited on the side of the data line 114.

In this configuration, the data electrode 114 opposite the pixel electrode 118 has a pixel capacitor formed using a liquid crystal layer as a dielectric material. Regardless of the data voltage supplied to the data line 114, a voltage for forcing the non-linear resistive element 109 connected to the scanning line 112 to be turned on is applied to the scanning line 112 as a selection voltage. The pixel capacitor in series connection with the non-linear resistive element 109 stores a voltage which is obtained by subtracting a voltage drop across the non-linear resistive element 109, which is currently turned on, from a voltage difference between the scanning line and the data line.

Then, when the scanning line 112 is then supplied with a non-selection voltage, the voltage applied to the non-linear resistive element 109 continuously remains below the threshold voltage Vth. Thus, thus non-linear resistive element 109 is turned off, thereby maintaining the voltage stored in the pixel capacitor.

For the pixel 120 at the intersection of the scanning line 112 and the data line 114, the voltage stored in the pixel capacitor can be varied by changing the data voltage applied to the data line 114 when the selection voltage is applied to the scanning line 112. In this way, the liquid crystal 105 of each pixel has predetermined optical characteristics.

The selection voltage and the data voltage to be applied to the pixel capacitor are typically periodically inverted in polarity alternately using a positive polarity voltage and a negative polarity voltage. To this end, first, the polarity of the pixel capacitor is controlled by a signal AK (see FIG. 1 and FIG. 5), second, the signal AK is fed to the scanning line driving circuit 130, and the circuit arrangement of the scanning line driving circuit 130 is modified so that the polarity of the selection voltage becomes the one represented by the signal AK, and third, the converter circuit 1440 in the data line driving circuit 140 is designed to output the data voltage in accordance with the polarity represented by the signal AK.

Since such an arrangement is easily embodied, no further discussion is provided.

A two-level voltage may be used as a signal for the data line, and the ratio of application of the two-level voltage can be controlled to change the voltage applied to the pixel capacitor during the application period of the selection voltage. In this driving method, predetermined optical characteristics are imparted to the liquid crystal. Since such an arrangement is easily embodied again, no further discussion is provided.

<Second Embodiment>

Figure 9:
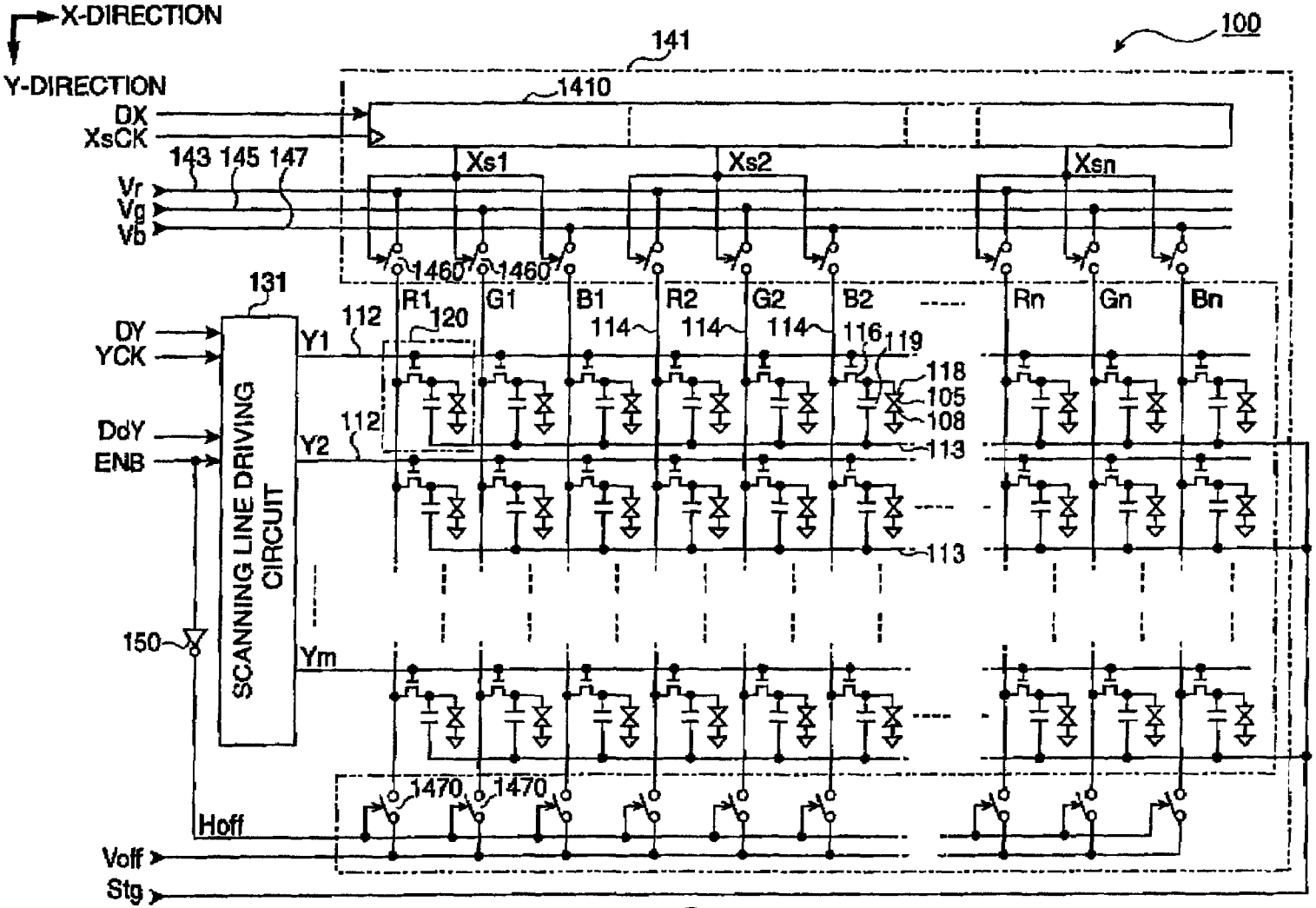
FIG. 9 is a block diagram illustrating the construction of a second embodiment of the present invention.

An electrooptical device of a second embodiment of the present invention is discussed below. FIG. 9 is a block diagram illustrating the configuration of the electrooptical device. As in the first embodiment, the electrooptical device of the second embodiment is a liquid-crystal device employing a liquid crystal as an electrooptical material. However, the electrooptical device of the second is different from that of the first embodiment in the following points (1), (2), and (3).

The pixel 120 in the first embodiment uses a P-channel TFT 116 for switching the pixel electrode 118. In the second embodiment, an N-channel TFT is used (a different point (1)). For this reason, in the second embodiment, the TFT 116 is turned on when the scanning signal fed to the scanning line 112 is at a high level. With the different point (1), the scanning signals Y1, Y2, Y3, . . . , Ym output from a scanning line driving circuit 131 of the second embodiment become logically inverted versions of the scanning signals output from the scanning line driving circuit 130 in the first embodiment.

In the first embodiment, the data signals that correspond to the display content of the pixels 120 are concurrently respectively fed to the data lines 114 (line-sequential supply) during the period in which the control signal ENB is HIGH and the scanning signal Y1 is LOW, or active. In the second embodiment, the data signals that corresponds to the display content of the pixels 120 are fed to the data lines 114 three lines at a time, corresponding to one dot (dot-sequential supply) during the period in which the control signal ENB is HIGH and the scanning signal Yi is HIGH, or active. The first and second embodiments are different in this point (a second different point (2)).

A data line driving circuit 141 in the second embodiment does not include the register 1420, the latch circuit 1430, and the converter circuit 1440. Alternatively, the data line driving circuit 141 includes a sampling switch 1460 arranged in one-to-one correspondence with one data line 114. Specifically, when a sampling control signal XsJ is driven high, three sampling switches 1460 of a j-th column dot, namely, of data lines 114 of 3(j−2)-th column, a 3(j−1)-th column, and 3j-th column, are turned on, whereby an R video signal Vr supplied through a signal line 143, a G video signal Vg supplied through a signal line 145, and a B video signal Vb supplied through a signal line 147 are fed to the respective data lines 114.

The video signals Vr, Vg, and Vb are voltage signals corresponding to the gray levels of the respective pixels 120, and correspond to analog signals having a polarity represented by the signal AK into which the gray scale data DR, DG, and DB discussed in the description of the first embodiment has been converted by the higher-order device (not shown).

In the first embodiment, the turned-off signal Voff is supplied through the switch 1450 arranged on one end of the data line 114. In the second embodiment, the turning-off signal Voff is supplied through a switch 1470 arranged on the other end of the data line 114. The first and second embodiments are different from each other in this point (a different point (3)). Specifically, the switch 1470 is turned on when the control signal Hoff, into which the control signal ENB has been converted by an inverter 150, is driven high. The corresponding data line 114 is thus supplied with the turning-off signal Voff. In other words, 3·n switches 1470 form a precharge circuit.

For convenience of explanation, the alternating-current driving of the liquid-crystal capacitor is not mentioned in the discussion of the first embodiment. The second embodiment is capable of performing the alternating-current driving method in which the polarity of the write voltage to the pixel is inverted every scanning line 112, and as for each pixel, the polarity of the write voltage to the pixel is inverted every vertical scanning period.

Figure 10:
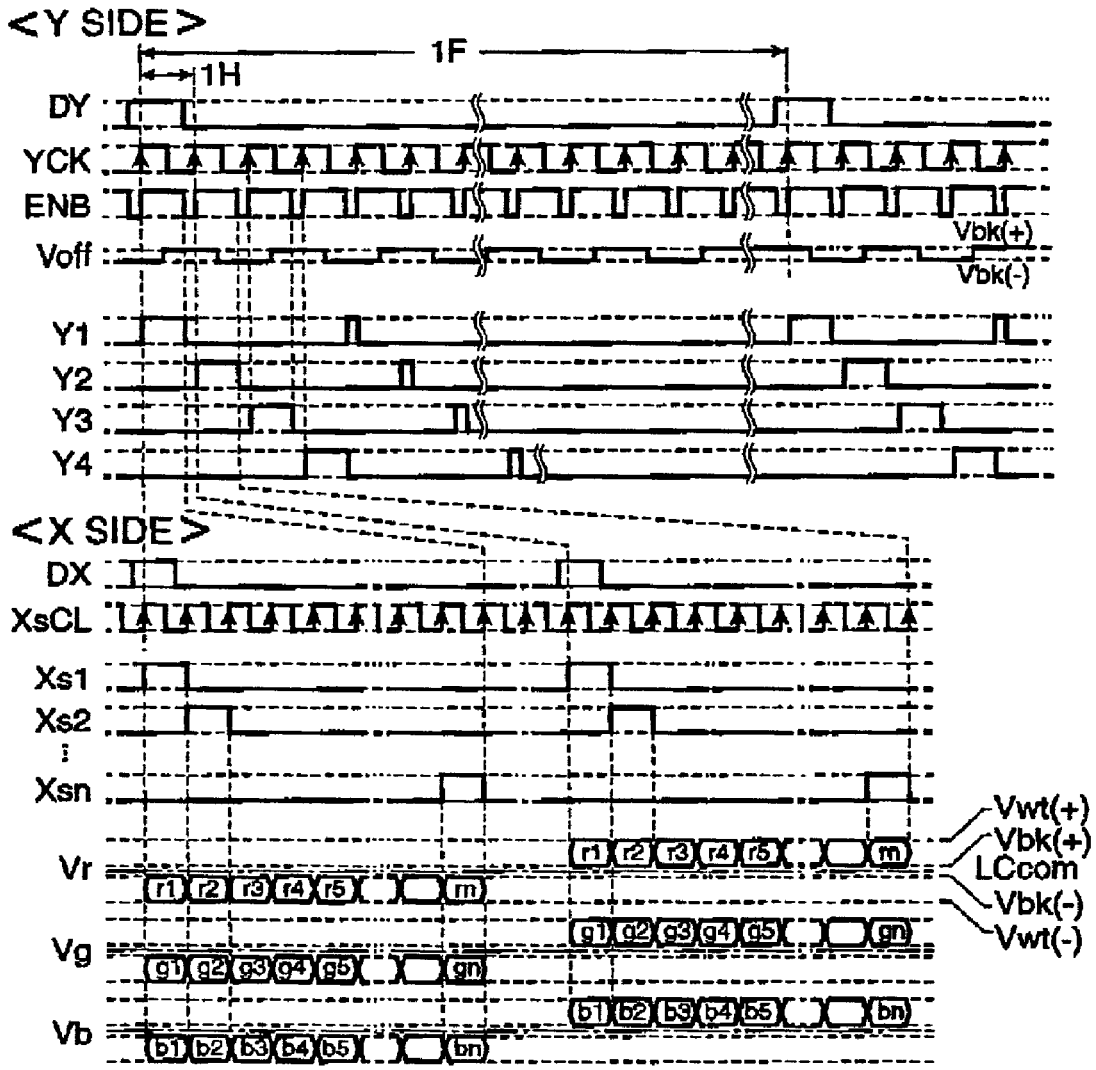
FIG.10 is a timing diagram illustrating the display operation of the electrooptical device.

The voltage serving as a reference on which polarity is determined is a voltage LCcom (or a voltage close to the voltage LCcom) applied to the above-mentioned opposing electrode 108. It is assumed that the electrooptical device of the second embodiment works in a normally black mode in which the amount of transmitted light decreases as the root-mean-square value of the voltage applied to the liquid-crystal capacitor is reduced. Based on this assumption, the voltages of the video signals Vr, Vg, and Vb change according to the gray level of the corresponding pixel within a range from a voltage Vbk(+) indicating black (turned-off) to a voltage Vwt(+) indicating white (turned-on) in a positive write operation as shown in FIG. 10. In a negative write operation, the voltages of the video signals Vr, Vg, and Vb change according to the gray level of the corresponding pixel within a range from a voltage Vbk(−) indicating black to a voltage Vwt(−) indicating white.

In this embodiment, the two turning-off signals Voff, namely, voltages Vbk(+) and Vbk(−), are present depending on the polarity of the write voltage, and supplied from the hierarchically higher device in the following manner. When the control signal ENB is driven low in the horizontal scanning period in which the i-th row scanning line 112 is selected, the turning-off signal Voff becomes the Vbk(+) if the writing of the voltage to the pixel in the (i+1)-th row scanning line 112 is a positive polarity writing, and becomes the Vbk(−) if the writing of the voltage to the pixel in the (i+1)-th row scanning line 112 is a negative polarity writing.

In other words, immediately subsequent to the writing of the display content, the voltage Vbk(−) having a polarity reverse to the write polarity is supplied as the turning-off voltage Voff as shown in FIG. 10.

A storage capacitor 119 is arranged in parallel with the liquid-crystal capacitor in each pixel 120.

In accordance with the second embodiment, when the control signal ENB is driven low (with the control signal Hoff transitioned to a high level) after the positive polarity writing is completed on the pixels 120 in the i-th row in a dot-sequential fashion according to the display content, the scanning signal Y(i−3) on three lines above is driven high, and all switches 1470 are turned on, and the voltage Vbk(−) corresponding to the negative polarity writing is applied to the data line 114. For this reason, all pixels 120 in the (i+3)-th row are forced to be in the turned-off state from the display state. This operation remains unchanged from that of the first embodiment.

The negative polarity writing to the pixels in the (i+1)-th scanning line 112 is performed in a dot-sequential fashion according to the display content. Since all data lines 114 are precharged with the voltage Vbk(−) immediately prior to the writing in this embodiment, workload involved in the negative polarity writing to be performed next is lightened.

In contrast, when the negative polarity writing to the i-th row pixels 120 is completed in a dot-sequential fashion, the voltage Vbk(+) corresponding to the positive polarity writing is applied to the data line 114. Thus, all pixels 120 in the (i−3)-th row are forced to be in the turned-off state from the display state, and workload involved in the positive polarity writing to be executed next is lightened.

The reduced workload involved in the writing operation is further discussed. Since the data line 114 has more or less parasitic capacitance, each data line 114 holds a voltage (reverse in polarity to a video signal currently sampled) of a video signal that is sampled one horizontal scanning period earlier than the current sampling. When the data line 114 samples the video signal in this state, the workload on the data line 114 becomes excessive, so that there are cases where prior to the sampling of the video signal, the data line 114 is precharged with a voltage of the same polarity as the writing voltage (for example, precharged with the voltage corresponding to white, black, or an intermediate level therebetween).

In the second embodiment, however, the turned-off voltage Voff that is applied to the data line 114 for forcing the pixel 120 to be in the turned-off state is also used as a precharge voltage. In this embodiment, since the application of the turning-off voltage Voff clears the charge from the liquid-crystal capacitor so that it becomes substantially equal to zero, the workload involved in the application of the video signal that corresponds to the display content is substantially small compared with the conventional art in which the reverse polarity voltages are alternately applied every horizontal scanning period.

In accordance with the second embodiment, since the pixel 120 is forced into the turned-off state while being precharged at the same time, it is not necessary to provide a particular period for precharging and the workload involved in the writing depending on the display content is lightened.

In the second embodiment, the video signal corresponding to the j-th column dot is sampled at the same time in response to a single sampling signal Xsj. However, the video signal may be expanded in time by p times (p is an integer larger than 1), and 3·p signal lines may be arranged so that the video signal for the p dots may be concurrently sampled. The number of video signals concurrently sampled is not important.

<Applications and Modifications>

The present invention is not limited to the first and second embodiments mentioned above. A variety of changes may be possible. For example, in the above discussion the gray scale data of each color is 4 bit and each color has 16 gray levels. The present invention is not limited to this arrangement. Multiple gray scales may be applied, and binary black and white display or gray scale display may be possible.

The description has been given so far based on the assumption that this embodiment works in the normally black mode in which a black display is presented with no voltage applied to the liquid-crystal capacitance. Alternatively, a normally white mode in which a white display is presented with no voltage applied to the liquid-crystal capacitance may be used. The present embodiment uses a transmissive type liquid-crystal device. Alternatively, the liquid-crystal device may be of a reflective type, or a transflective type which is a combination of the reflective type and the transmissive type.

In the discussion of the embodiments, black corresponds to the turned-off state and white corresponds to the turned-on state. Conversely, white may correspond to the turned-off state and black may correspond to the turned-on state.

The above embodiment is arranged so that the period of the scanning signal Ym for the active level (a low level in the first embodiment and a high level in the second embodiment) for causing the pixels in the final m-th scanning line 112 to be in the turned-off state comes prior to the period of the scanning signal Y1 for causing the pixels in the first scanning line 112 in the next vertical scanning period. Alternatively, the period of the scanning signal Ym may be set to come subsequent to the period of the scanning signal Y1 in time so that they overlap each other.

In this embodiment, the number of rows of the pixels 120 to be placed in the turned-on state is four, but it can be any number equal to or greater than 1. The number of rows of the pixels 120 to be placed in the turned-on state should be determined depending on the characteristics and luminance of a display device to which the present invention is applied.

The scanning line driving circuit 130 has been discussed for exemplary purposes only. For example, the transfer signal Yai falling within the high-level period of the control signal ENB may be extracted and used as a scanning signal for causing the pixels in the i-th row scanning line 112 to present the display content, and the transfer signal Yai falling within the low-level period of the control signal ENB may be extracted and used as a scanning signal for forcing the pixels in the (i−3)-th scanning line 112 to be in the non-lighting state.

<Electronic Equipment>

Electronic equipment incorporating the electrooptical device of the above embodiments will be discussed.

<Electronic Equipment 1: Projector>

Figure 11:
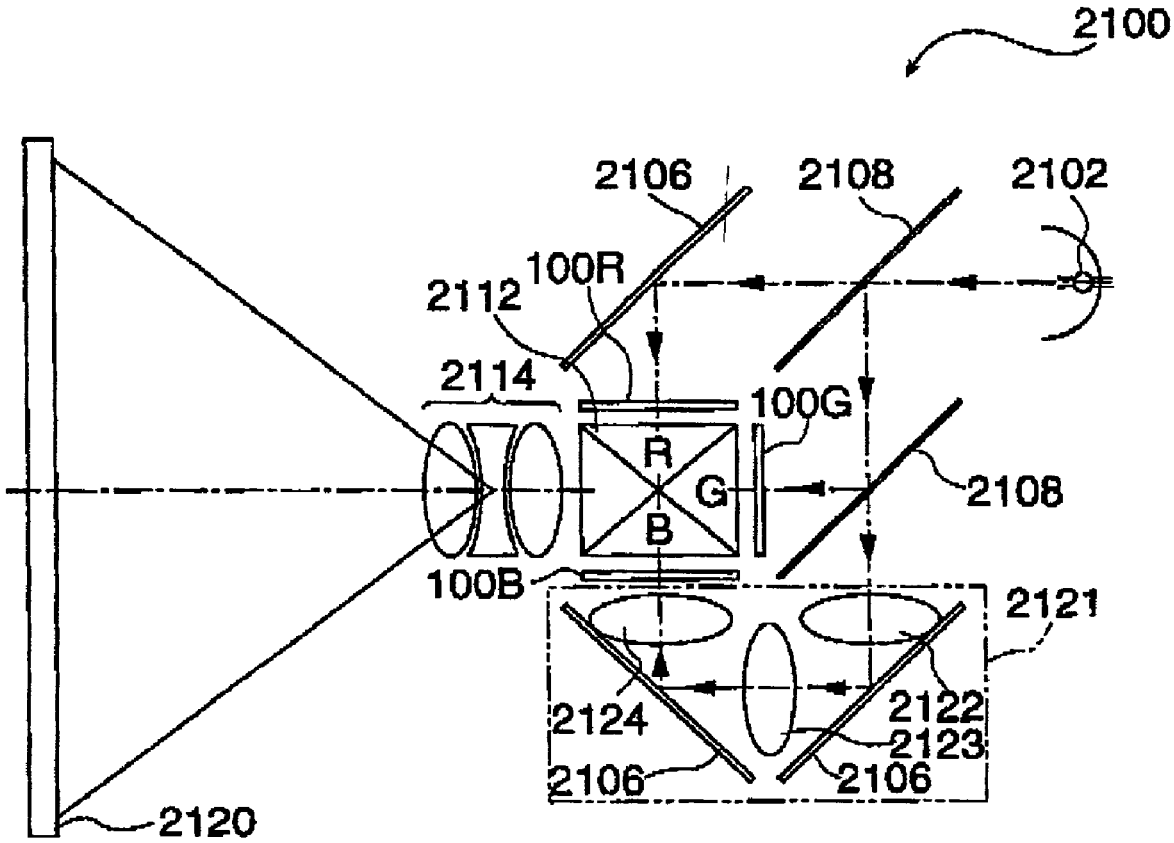
FIG. 11 is a perspective view of a projector which is one example of electronic equipment in which the electrooptical device of each embodiment of the present invention is implemented.

Discussed first is a projector which uses the electrooptical device 100 of each of the above embodiments as a light valve. FIG. 11 is a plan view showing the projector. As shown in the figure, the projector 2100 includes a lamp unit 2102 composed of a white-light source such as a halogen lamp. The light beam projected from the lamp unit 2102 is separated into the three R (red), G (green), and B (blue) color beams through internally arranged three mirrors 2106 and two dichroic mirrors 2108. The three color light beams are then guided to respective light valves 100R, 100G, and 100B.

The light valves 100R, 100G, and 100B are identical in construction to the electrooptical device 100 of each of the above-referenced embodiments, namely, the transmissive type liquid-crystal device. In other words, the light valves 100R, 100G, and 100B function as a light modulator for generating the RGB color image.

The B color beam travels along a path longer than those for the R and G color beams. To prevent loss, the B color beam is guided through a relay lens system 2121, composed of an incident lens 2122, a relay lens 2123, and an exit lens 2124.

The R, G, and B light beams respectively color-modulated by the electrooptical devices 100R, 100G, and 100B are incident on a dichroic prism 2112 in three directions. The R and B color beams are refracted at 90° by the dichroic prism 2112, while the G color beam travels straight. The three color images are synthesized, and a synthesized color image is then projected by a projection lens 2114 onto a screen 2120.

<Electronic Equipment 2: Personal Computer>

Figure 12:
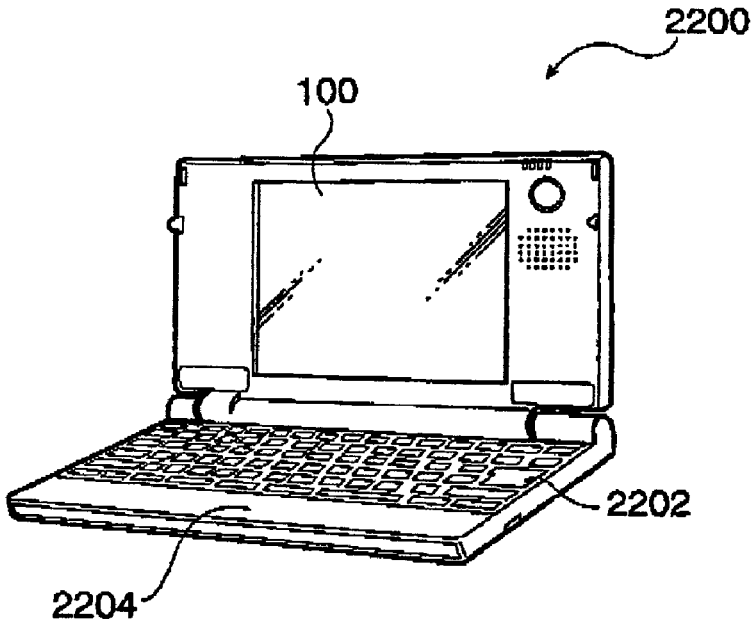
FIG. 12 is a perspective view of a personal computer which is one example of electronic equipment in which the electrooptical device of each embodiment of the present invention is implemented.

Discussed here is a mobile computer incorporating the above-referenced electrooptical device 100. FIG. 12 is a perspective view of the construction of the personal computer.

The computer 2200 includes a main unit 2204 having a keyboard 2202, and the electrooptical device 100 as a display unit. When a transmissive type liquid-crystal device is used as the electrooptical device 100, a back light unit (not shown) is provided on the back to assure higher visibility in dark places.

<Electronic Equipment 3: Mobile Telephone>

Figure 13:
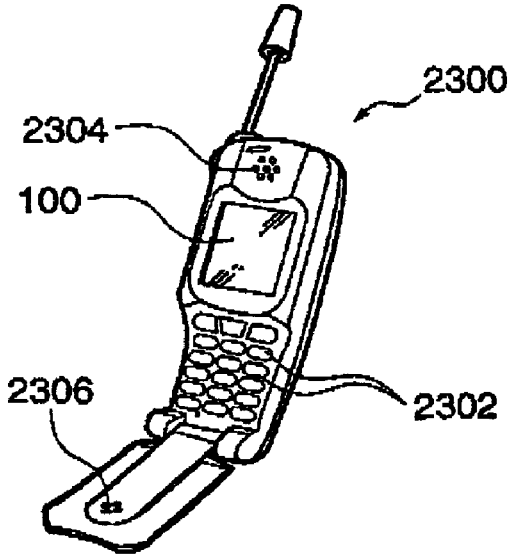
FIG. 13 is a perspective view of a mobile telephone which is one example of electronic equipment in which the electrooptical device of each embodiment of the present invention is implemented.

Discussed next is a mobile telephone incorporating the above-referenced electrooptical device 100. FIG. 13 is a perspective view of the mobile telephone.

As shown in the figure, the mobile telephone 2300 includes a plurality of control buttons 2302, a earpiece 2304, a mouthpiece 2306, and the electrooptical device 100. When a liquid-crystal device is employed as the electrooptical device 100, it includes a back light in the transmissive type or a transflective type (not shown), or a front light in the reflective type (not shown) to assure higher visibility in dark places.

Besides the projector shown in FIG. 11, the personal computer shown in FIG. 12, and the mobile telephone shown in FIG. 13, the electronic equipment of the present invention may be any of a diversity of electronic equipment including a liquid-crystal display television, a viewfinder type or direct monitoring type video cassette recorder, a car navigation system, a pager, an electronic pocketbook, an electronic tabletop calculator, a word processor, a workstation, a video phone, a POS terminal, and an apparatus having a touch panel. The above-referenced electrooptical device may be incorporated in these pieces of electronic equipment as a display thereof.

[Advantages]

In accordance with the above-referenced present invention, the pixel presents a display that corresponds to a display content from the moment a first selection voltage is applied to the scanning line until the moment a second selection voltage is applied to the scanning line. When a moving picture is presented, the generation of an after image is controlled.

What is claimed is:

1. A driving circuit of an electrooptical device to drive a pixel arranged at an intersection of a scanning line of multiple scanning lines and a data line of multiple data lines, comprising:

a scanning line driving circuit which drives a first shift register and a second shift register, the first shift register including an OR gate provided at an output of the first shift register in a one-to-one correspondence with a scanning line, the OR gate of the first shift register outputting an OR signal that is obtained by combining a corresponding transfer signal and an inverted version of a control signal that is controlled by a write period of a signal representing a display content of the pixel and a write period of a signal for forcefully causing the pixel to be in a turning-off state, the second shift register including an OR gate provided at an output of the second shift register in a one-to-one correspondence with a scanning line, the OR gate of the second shift register outputting an OR signal that is obtained by combining the corresponding transfer signal and the control signal, the first shift register latching a first pulse signal, the second shift register latching a second pulse signal that is delayed from the first pulse signal, the scanning line driving circuit selecting a scanning line, supplying a scanning signal that combines an output of the first shift register and an output of the second shift register to the selected scanning line, and applying a first selection voltage to the selected scanning line, the scanning line driving circuit selecting the selected scanning line again after selecting at least one other scanning line, and applying a second selection voltage to the selected scanning line; and a data line driving circuit which supplies a data line with a signal that corresponds to the display content of the pixel at the intersection of the scanning line and the data line when the scanning line is supplied with the first selection voltage, and which supplies the data line with a turning-off signal in accordance with the inverted version of the control signal, the turning-off signal causing the pixel to be placed in a turned-off state regardless of the display content of the pixel when the scanning line is supplied with the second selection voltage.

2. The driving circuit of an electrooptical device according to claim 1, the data line driving circuit including a precharge circuit which supplies all data lines with the turning-off signal when the scanning line is supplied with the second selection voltage.

3. A driving method of an electrooptical device to drive a pixel arranged at an intersection of a scanning line of multiple scanning lines and a data line of multiple data lines, comprising:

latching a first pulse signal at a first shift register, the first shift register including an OR gate provided at an output of the first shift register in a one-to-one correspondence with a scanning line, the OR gate of the first shift register outputting an OR signal that is obtained by combining a corresponding transfer signal and an inverted version of a control signal that is controlled by a write period of a signal representing a display content of the pixel and a write period of a signal for forcefully causing the pixel to be in a turning-off state;

latching a second pulse signal at a second shift register, the second pulse signal being delayed from the first pulse signal, the second shift register including an OR gate provided at an output of the second shift register in a one-to-one correspondence with a scanning line, the OR gate of the second shift register outputting an OR signal that is obtained by combining the corresponding transfer signal and the control signal;

selecting a scanning line;

supplying a scanning signal that combines an output of the first shift register and an output of the second shift register to the selected scanning line;

supplying a first selection voltage to the selected scanning line;

selecting the scanning line again after selecting at least one other scanning line;

supplying a second selection voltage to the selected scanning line;

supplying a data line with a signal that corresponds to a display content of the pixel at the intersection of the scanning line and the data line when the scanning line is supplied with the first selection voltage; and supplying the data line with a turning-off signal in accordance with the inverted version of the control signal, the turning-off signal causing the pixel to be placed in a turned-off state regardless of the display content of the pixel when the scanning line is supplied with the second selection voltage.

4. An electrooptical device having a pixel arranged at an intersection of a scanning line of multiple scanning lines and a data line of multiple data lines, comprising:

a scanning line driving circuit which drives a first shift register and a second shift register, the first shift register including an OR gate provided at an output of the first shift register in a one-to-one correspondence with a scanning line, the OR gate of the first shift register outputting an OR signal that is obtained by combining a corresponding transfer signal and an inverted version of a control signal that is controlled by a write period of a signal representing a display content of the pixel and a write period of a signal for forcefully causing the pixel to be in a turning-off state, the second shift register including an OR gate provided at an output of the second shift register in a one-to-one correspondence with a scanning line, the OR gate of the second shift register outputting an OR signal that is obtained by combining the corresponding transfer signal and the control signal, the first shift register latching a first pulse signal, the second shift register latching a second pulse signal that is delayed from the first pulse signal, the scanning line driving circuit selecting a scanning line, supplying a scanning signal that combines an output of the first shift register and an output of the second shift register to the selected scanning line, and applying a first selection voltage to the selected scanning line, the scanning line driving circuit selecting the selected scanning line again after selecting at least one other scanning line, and applying a second selection voltage to the selected scanning line; and a data line driving circuit which supplies a data line with a signal that corresponds to a display content of the pixel at the intersection of the scanning line and the data line when the scanning line is supplied with the first selection voltage, and which supplies the data line with a turning-off signal in accordance with the inverted version of the control signal, the turning-off signal causing the pixel to be placed in a turned-off state regardless of the display content of the pixel when the scanning line is supplied with the second selection voltage.

5. The electrooptical device according to claim 4, the pixel including:

a pixel electrode;

an opposing electrode opposed to the pixel electrode; and a liquid crystal layer sandwiched between the pixel electrode and the opposing electrode and having optical characteristics which vary depending on a voltage applied between the pixel and opposing electrodes.

6. The electrooptical device according to claim 5, a signal that is applied to the pixel electrode when the scanning line is supplied with the first selection voltage being inverted in polarity with respect to a voltage applied to the opposing electrode as a reference for each at least one vertical scanning period; and the signal that is applied to the pixel electrode when the scanning line is supplied with the first selection voltage having a polarity that is the inverse of the polarity of the turning-off signal that is applied to the pixel electrode when the scanning line is supplied with the second selection voltage.

7. The electrooptical device according to claim 4, the pixel including:

a pixel electrode;

a non-linear resistive element connected to the pixel electrode; and a liquid-crystal layer sandwiched between the pixel electrode and one of the data line and the scanning line and having optical characteristics that vary depending on a voltage applied therebetween.

8. The electrooptical device according to claim 7, a signal that is applied to the pixel electrode when the scanning line is supplied with the first selection voltage being inverted in polarity with respect to the voltage applied to the data line or the scanning line as a reference for each at least one vertical scanning period; and the signal that is applied to the pixel electrode when the scanning line is supplied with the first selection voltage having a polarity that is the inverse of the polarity of the turning-off signal that is applied to the pixel electrode when the scanning line is supplied with the second selection voltage.

9. The electrooptical device according to claim 4, the pixel including:

a pixel electrode;

an opposing electrode opposed to the pixel electrode; and a light emitting layer sandwiched between the pixel electrode and the opposing electrode, an amount of emitting light varying depending on a current flowing therebetween.

10. Electronic equipment, comprising:

the electrooptical device according to claim 4.

11. Electronic equipment, comprising:

the electrooptical device according to claim 5.

12. Electronic equipment, comprising:

the electrooptical device according to claim 6.

13. Electronic equipment, comprising:

the electrooptical device according to claim 7.

14. Electronic equipment, comprising:

the electrooptical device according to claim 8.

15. Electronic equipment, comprising:

the electrooptical device according to claim 9.

* * * * *